US008292673B2

(12) United States Patent
Zhu

(10) Patent No.: US 8,292,673 B2
(45) Date of Patent: Oct. 23, 2012

(54) ELECTRICAL CONNECTOR WITH TERMINALS DEPRESSED FROM MATING SURFACES

(75) Inventor: Yu Zhu, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/113,947

(22) Filed: May 23, 2011

(65) Prior Publication Data

US 2012/0052741 A1 Mar. 1, 2012

(30) Foreign Application Priority Data

Sep. 1, 2010 (CN) ..... 2010 2 0513031

(51) Int. Cl.
*H01R 24/00* (2006.01)

(52) U.S. Cl. ..... 439/660

(58) Field of Classification Search ..... 439/660, 439/83, 70, 79, 62
See application file for complete search history.

(56) References Cited

U.S. PATENT DOCUMENTS 5,667,393 A * 9/1997 Grabbe et al. ..... 600/443
6,106,338 A * 8/2000 Wu et al. ..... 439/660
6,500,013 B1 * 12/2002 Wang ..... 439/108
7,654,871 B2 * 2/2010 Yi et al. ..... 439/660

* cited by examiner

*Primary Examiner* — Jean F Duverne
(74) *Attorney, Agent, or Firm* — Wei Te Chung; Ming Chieh Chang

(57) ABSTRACT

An electrical connector includes an insulative housing and a plurality of terminals retained in the housing. The insulative housing includes a mating cavity and a tongue portion in the mating cavity. The tongue portion defines a mating surface confronting with the mating cavity and a plurality of grooves arranged along a first direction of the tongue portion and extending in a mating direction of the connector. The grooves are recessed from the mating face. The terminals are retained in the housing and comprise contacting portions extending in corresponding groove. The contacting portions define contacting faces parallel to the mating face and communicating with the mating cavity in a second direction perpendicular to the first direction and the mating direction. The grooves are disposed so deeply that the contacting faces of the terminals are recessed from the mating face.

7 Claims, 5 Drawing Sheets

ELECTRICAL CONNECTOR WITH TERMINALS DEPRESSED FROM MATING SURFACES

FIELD OF THE INVENTION

The present invention generally relates to an electrical connector which has terminals depressed from a mating surface thereof.

DESCRIPTION OF RELATED ART

An electrical connector comprises an insulative housing and a number of terminals retained in the insulative housing. The insulative housing comprises a tongue portion defining a mating surface. A plurality of passageways are arranged along an elongated direction penetrate through the mating surface of the tongue portion, and the terminals comprises planar mating portions received in the corresponding passageways and exposed to an exterior. The mating portions of the terminals define a contact surface substantially aligned with the mating surface. A mating connector comprises an insulative housing and a plurality of mating terminals retained in the insulative housing. The mating terminal comprises cantilevered mating sections. When the two connectors mate with each other, the cantilevered mating sections are easy to shift along the elongated direction of the tongue portion.

Hence, an improved electrical connector is highly desired to overcome the aforementioned problems.

SUMMARY OF THE INVENTION

The present invention provides an electrical connector including an insulative housing and a plurality of terminals retained in the housing. The insulative housing includes a mating cavity and a tongue portion in the mating cavity. The tongue portion defines a mating surface confronting with the mating cavity and a plurality of grooves arranged along a first direction of the tongue portion and extending in a mating direction of the connector. The grooves are recessed from the mating face. The terminals are retained in the housing and comprise contacting portions extending in corresponding groove. The contacting portions define contacting faces parallel to the mating face and communicating with the mating cavity in a second direction perpendicular to the first direction and the mating direction. The grooves are disposed so deeply that the contacting faces of the terminals are recessed from the mating face.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
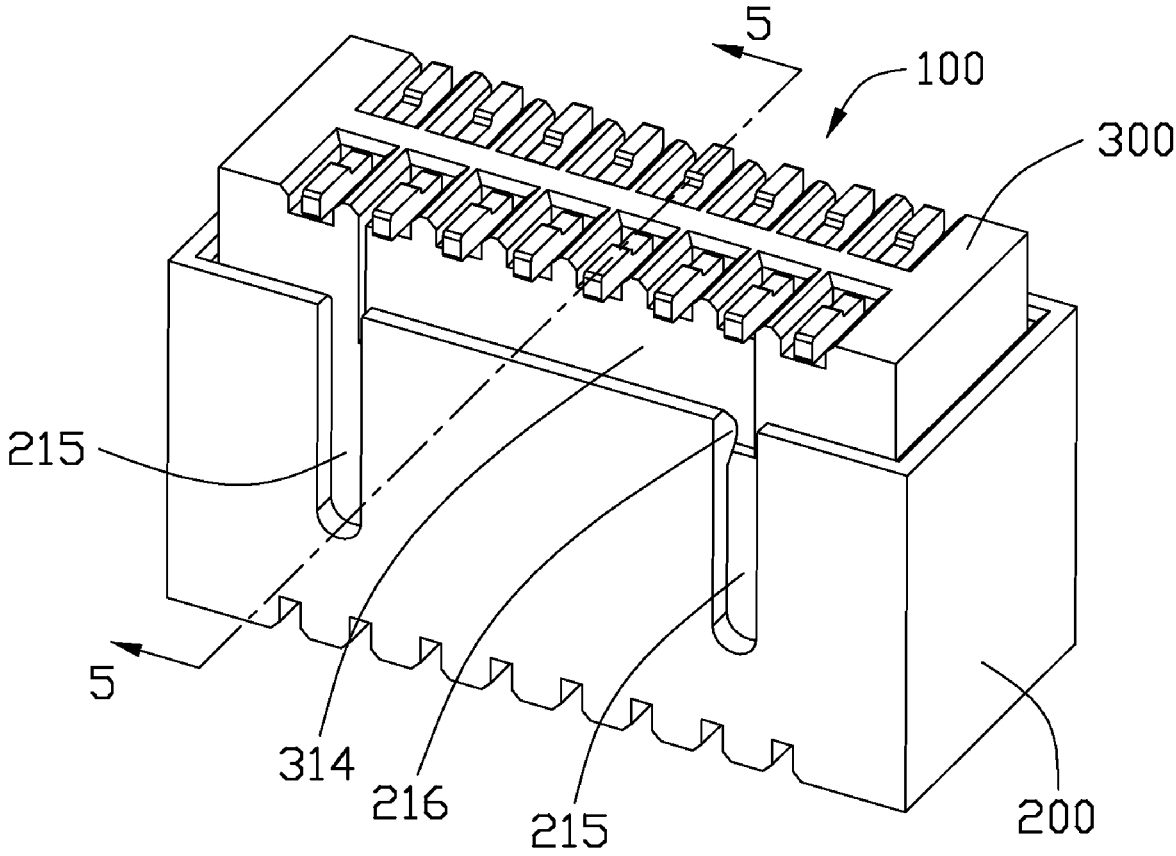
FIG. 1 is a perspective view of an electrical connector assembly of an embodiment of the present invention.

Referring to FIG. 1, an electrical connector assembly 100 in accordance with the present invention comprises a first connector 200 and a second connector 300 mating with each other.

Figure 2:
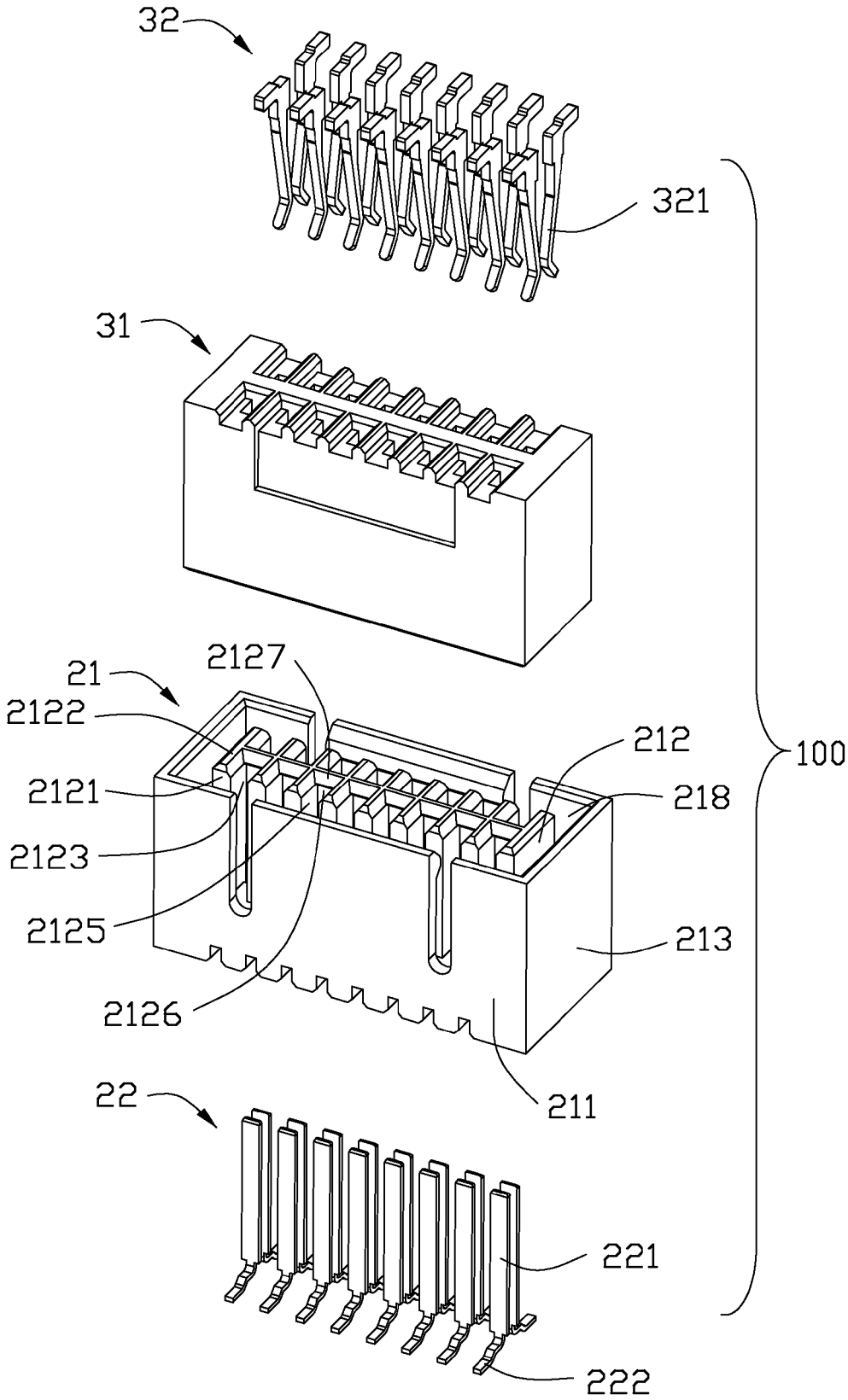
FIG. 2 is an exploded, perspective view of FIG. 1.
Figure 3:
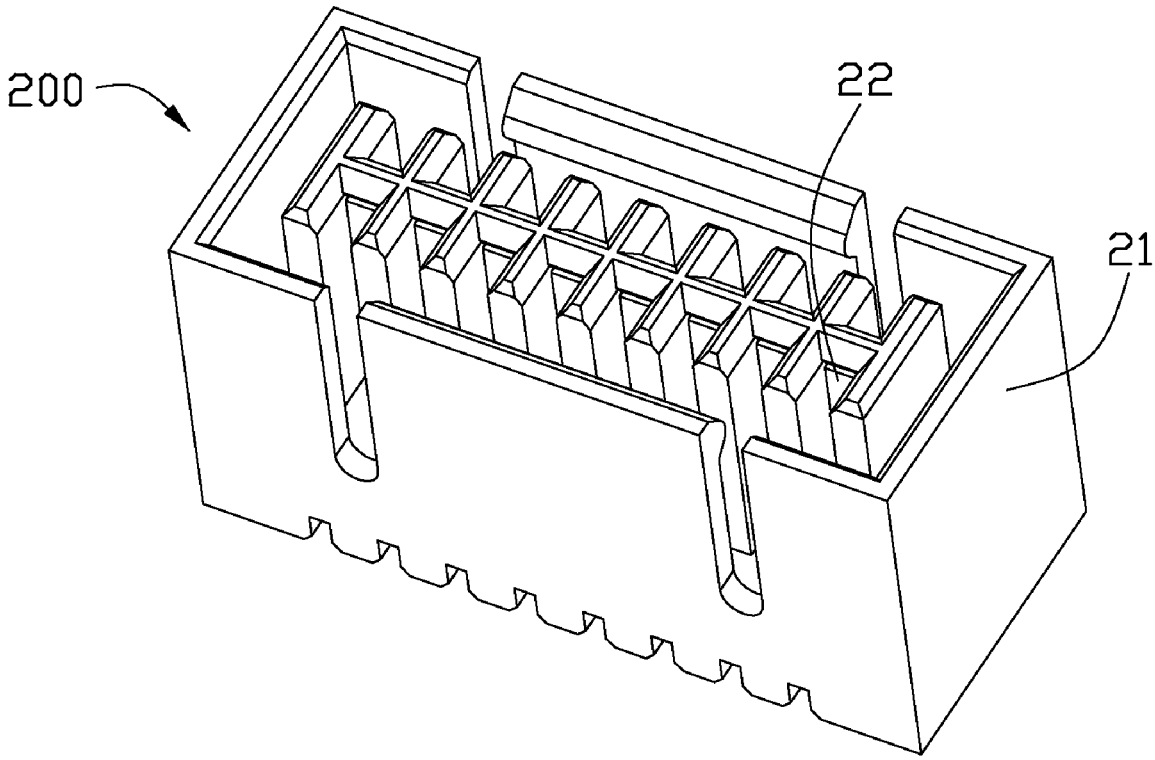
FIG. 3 is another perspective view of the first electrical connector in FIG. 1.

Referring to FIGS. 2 and 3, the first connector 200 comprises a first insulative housing 21 and a plurality of first terminals 22 retained in the first insulative housing 21. The first insulative housing 21 comprises a base portion 211, a tongue portion 212 extending from a side of the base portion 211 and a frame portion 213 separately enclosing the tongue portion 212 to define a mating cavity 218. The tongue portion 212 defines opposite mating surfaces 2121 in the mating cavity and an end surface 2122 perpendicular to the mating surfaces 2121 which is also perpendicular to a mating direction of the assembly. A mounting surface is disposed opposite to the end surface 2122. A plurality of grooves 2123 arranged in two rows at said two mating surface along a first direction perpendicular to the mating direction penetrate through the mating surfaces 2121 in a second direction perpendicular to the first direction and the mating direction and the end surface 2122 in the mating direction. Two rows of passageways continuously extend from the grooves 2123 through the base portion. The first terminals 22 retained in the passageways comprise contacting portions 221 extending in the grooves towards the end surface 2122 and tail portions 222 extending beyond the mounting surface. The contacting portions 221 respectively communicate with the mating cavity 216 in the second direction and spaced apart from the corresponding mating surface 2121 with a distance with a height of the contacting portion.

Figure 4:
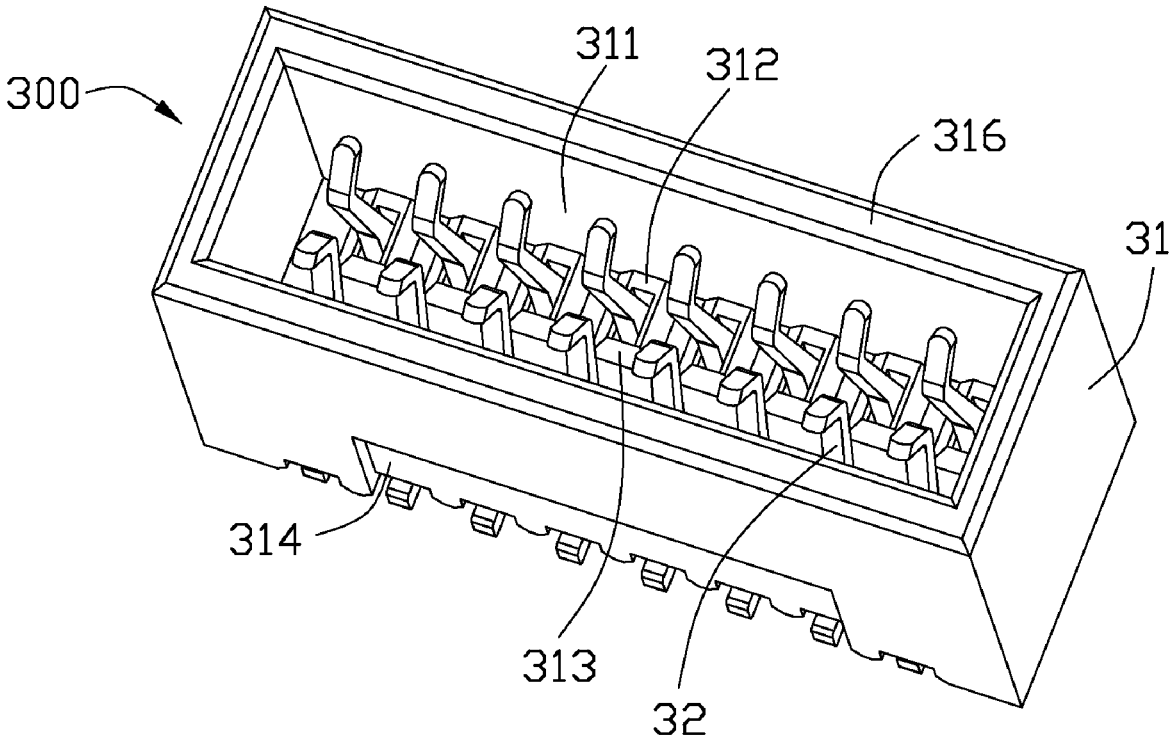
FIG. 4 is a perspective view of the second electrical connector in FIG. 1.

Referring to FIGS. 2 and 4, the second connector 300 comprises a second insulative housing 31 and a plurality of second terminals 32 assembled to the second insulative housing 31. The second insulative housing 31 defines an end surface 316 confronting with said end surface of the first connector and a receiving cavity 311 recessed inward from the end surface 316. Each second terminal 32 are retained in a base/bottom wall of the insulating housing opposite to the end surface 316 with a deflectable contacting arm 321 extending in the receiving cavity toward the end surface 316. A plurality of protrusions 312 inwardly project from the bottom wall to the receiving cavity 311 to enclose roots of the mating portions of the second terminals 32.

Figure 5:
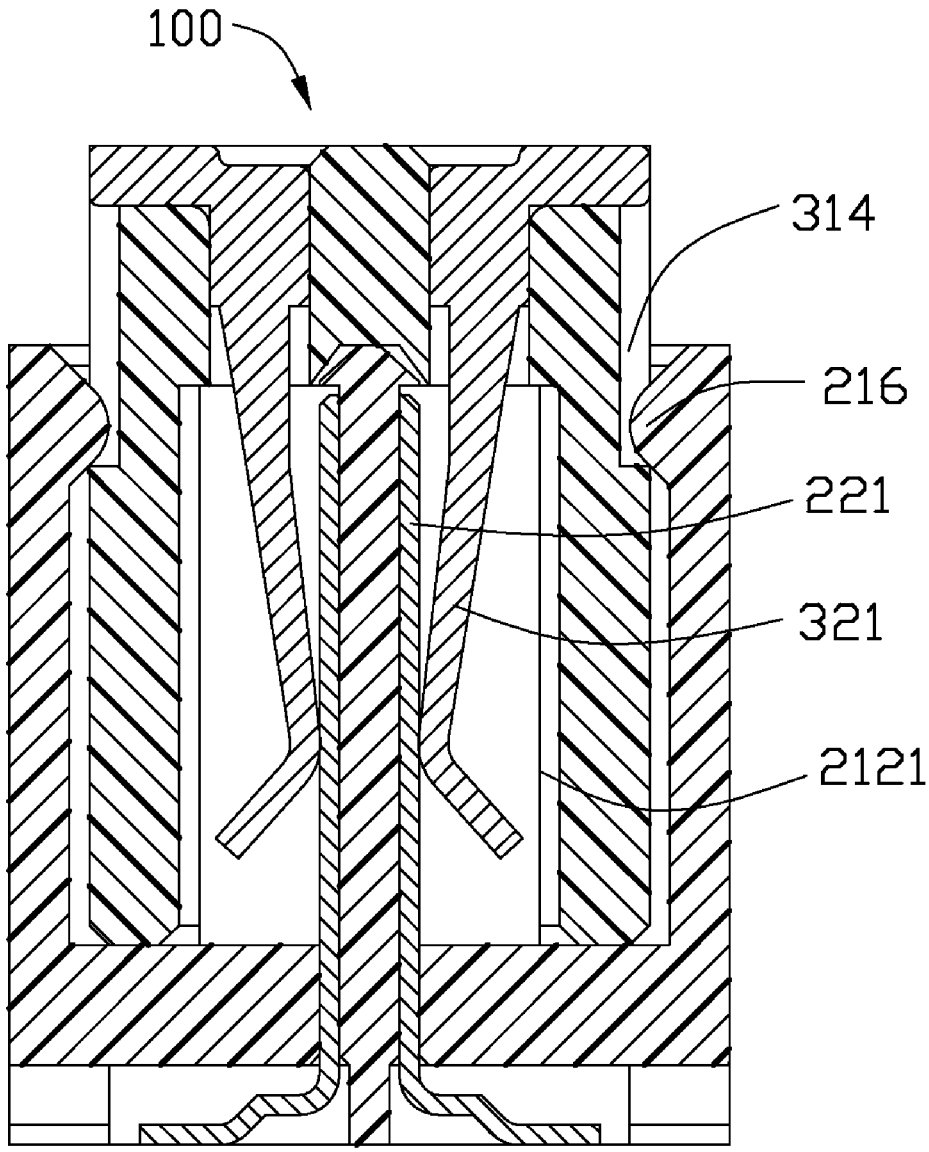
FIG. 5 is a cross sectional view of the electrical connector assembly taken along line 5-5 in FIG. 1.

Referring FIGS. 2 and 5, each of the grooves 2123 defines two opposite side surfaces 2125 perpendicular to the mating surface 2121 and a bottom surface 2126 parallel to the mating surface 2121. Each groove 2123 defines chamfer 2127 at an intersection outline of end surface 2122 with the bottom surface 2126 and the two side faces 2125. Each of the protrusions 312 labeled in FIG. 4 defines slant surfaces 313 adapted to mate with the chamfers 2127 of the grooves 2123. The deflectable contacting arms 321 of the second terminals 32 are fully inserted into the corresponding grooves 2123 and respectively abut against the contact portions 221 of the first terminals 22 to get an engagement of said first and second terminals. Since the stiff contacting portions of the first terminals are hind in the grooves, the deflectable contacting arms 321 of the second terminals are limited by the side face 2125 of the groove and do not extend beyond the mating surfaces 2122. Moreover, the deflectable contacting arms 321 are unsupported by the insulative housing and are guided by the grooves during mating of the two connectors.

The frame portion 213 of the first insulative housing 21 comprises a pair of opposite sidewalls parallel to the tongue portion 212. Two pairs of slots 215 run through one end of the two sidewalls of the frame portion 213 opposite to the base portion 211 to form a latch means with elasticity between the two slots 215. The latch means comprises a latch portion 216 at tips thereof projecting inwardly. The second insulative housing 31 defines two recesses 314 located in the outside. The recesses 314 are engaged with the latch portions 216 of the first insulative housing so as to a retention force between the first connector 200 and the second connector 300.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a first connector comprising a first insulative housing having a tongue portion and a plurality of first terminals comprising stiff first contacting portions arranged along the mating tongue; and a second connector comprising a second insulative housing defining a receiving cavity to receive the first connector and a plurality of second terminals comprising deflectable contacting arms exposing to the receiving cavity to contact with the first contacting portions when the second connector is mated with the first connector;

wherein the deflectable contacting arms of the second terminals are unsupported by the second insulative housing and prevented from shifting by the first connector when the second connector is mated with the first connector.

2. The electrical connector assembly as recited in claim 1, wherein the receiving cavity defines protrusions enclosing roots of the deflectable contacting arms at an inside bottom face thereof.

3. The electrical connector assembly as recited in claim 1, wherein the tongue portion defines a mating surface through which the first contacting portions communicate with the mating cavity and the first contacting portions are recessed from the mating surface.

4. The electrical connector assembly as recited in claim 1, wherein the deflectable contacting arms hide in the tongue portion and do not extend beyond the mating surface of the first connector after connection of said two connectors.

5. An electrical connector assembly comprising:

an electrical connector defining an insulative housing including a mating tongue defining thereon at least one mating face facing to an exterior in a transverse direction;

a plurality of grooves formed in the mating face and communicating with the exterior in the transverse direction and in a front-to-back direction perpendicular to said transverse direction;

a plurality of contacts disposed in the insulative housing with contacting sections each embedded in a bottom of the corresponding groove in an un-deflectable manner; wherein each of said grooves is dimensioned to be deep enough for completely receiving a deflectable contacting arm of a corresponding mating contact of a mating connector therein; wherein the first housing defines a circumferential wall surrounding the mating tongue; wherein the circumferential wall defines deflectable section with a protrusion at a tip for engagement within a recess formed in an exterior wall of the mating connector.

6. The electrical connector assembly as claimed in claim 5, wherein the mating tongue defines a center plate against which the contacting sections abut, and a front edge of the center plate defines a protruding structure adapted to be received in a corresponding recess in the mating connector.

7. The electrical connector assembly as claimed in claim 5, wherein a thickness direction of the contacts is perpendicular to a longitudinal direction of the housing which is perpendicular to both the transverse direction and the front-to-back direction, while another thickness direction of the mating contacts is parallel to said longitudinal direction.

* * * * *